US007250840B2

(12) United States Patent
Osugi

(10) Patent No.: US 7,250,840 B2
(45) Date of Patent: Jul. 31, 2007

(54) LAYERED PRODUCT

(75) Inventor: Ryo Osugi, Fukui (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 102 days.

(21) Appl. No.: 11/090,277

(22) Filed: Mar. 28, 2005

(65) Prior Publication Data

US 2005/0214515 A1 Sep. 29, 2005

(30) Foreign Application Priority Data

Mar. 29, 2004 (JP) ..... P. 2004-094379

(51) Int. Cl.
*H01F 7/02* (2006.01)
*H01F 1/055* (2006.01)

(52) U.S. Cl. ..... 335/302; 335/306; 148/302; 148/303

(58) Field of Classification Search ..... 148/302–303; 335/302–306
See application file for complete search history.

(56) References Cited

U.S. PATENT DOCUMENTS 4,128,823 A * 12/1978 Tanaka et al. ..... 335/196
4,279,668 A * 7/1981 Kurz et al. ..... 148/301
5,403,408 A * 4/1995 Krause et al. ..... 148/302
5,658,396 A * 8/1997 Sakurada et al. ..... 148/301
5,840,375 A * 11/1998 Katsumi et al. ..... 427/600
5,948,179 A * 9/1999 Hasegawa et al. ..... 148/301
6,017,402 A * 1/2000 Sukigara et al. ..... 148/301
6,174,609 B1 * 1/2001 Katsumi et al. ..... 428/450
6,399,150 B1 * 6/2002 Yoshimura et al. ..... 427/242
6,444,328 B1 * 9/2002 Nishiuchi et al. ..... 428/469
6,677,692 B1 * 1/2004 Sato et al. ..... 310/89
6,788,178 B2 * 9/2004 Inase et al. ..... 335/306
7,053,745 B2 * 5/2006 Yoshimura et al. ..... 335/302

FOREIGN PATENT DOCUMENTS

JP 2003-338419 A 11/2003

* cited by examiner

*Primary Examiner*—Cathy F. Lam
(74) *Attorney, Agent, or Firm*—Birch, Stewart, Kolasch & Birch, LLP

(57) ABSTRACT

A layered product prepared by applying a surface treatment to an adherend having a surface with a low binding property with an anaerobic adhesive, which does not require a complex work, primer application, effected by accelerating an adhesive curing rate, and does not change surface conditions of the adherend. The layered product comprises an adherend, an uneven deposition comprising Cu, V, a Cu alloy or a V alloy and having a height of 500 nm or less on the surface of the adherend, and an adhesive layer formed at least on the uneven deposition.

8 Claims, 1 Drawing Sheet

LAYERED PRODUCT

FIELD OF THE INVENTION

The present invention relates to a layered product comprising an adherend and an adhesive layer arranged on the surface of the adherend.

BACKGROUND OF THE INVENTION

In the field of electronic parts and the like, anaerobic adhesives are often used in mutually fixing parts. This is due to the superior workability of anaerobic adhesive; that is, the anaerobic adhesive also has an ultraviolet ray (UV) curing property in most cases, and the adhesive is cured within a short period of time effected by the UV irradiation and anaerobic property.

However, when a coat having a low binding property with an anaerobic adhesive, such as Ni plating, is formed on an adherend, the adhesive may not be cured within a short period of time, which causes a problem in that peeling is liable to occur. Thus, it was necessary to apply a primer as a curing accelerator to the adhering face of an adherend having such a surface. An organic solvent mainly containing Cu ion, V ion and the like which accelerates the curing rate of the anaerobic adhesive is mainly used as the primer. It is a complex work to apply a primer to the whole adhering face of an adherend on which a coat having a low binding property with an anaerobic adhesive is formed, causing increase in costs.

In addition, when it is intended to adhere a layer on an adherend on which a coat having a low binding property with an anaerobic adhesive has been formed by using an anaerobic adhesive and without carrying out the primer application, it is possible to use a technique in which the adherend is fixed using a jig or the like in order to prevent its misregistration during the UV irradiation and then allowed to stand for a prolonged period of time, heated or the like. However, such a technique is more complex than the primer application and in the actual situation, this is not carried out in general.

Exceptionally, in the case where the adherend is a magnetized magnet and a ferromagnetic material such as silicon steel plate is used as the material to be laminated, by utilizing the magnetic force, the anaerobic adhesive may be cured by the UV irradiation for a short period of time without using a jig or the like. However, even in such a case, a positioning jig is generally used to prevent a misregistration of the magnet during the irradiation, because the magnetic force is not as strong as the adhesion strength in general. In this regard, when the jig is removed without confirming that the adhesive is sufficiently cured by the UV irradiation, an adhesion failure such as a misregistration of the magnet or a peeling of the adhesive occurs in some cases.

The R—Fe—B type permanent magnets (wherein R is at least one of rare-earth elements including Y) are rare-earth magnets which are inexpensive, rich in terms of resource and superior in magnetic properties in comparison with the conventional Sm—Co permanent magnets. However, since the R—Fe—B type permanent magnets themselves are easily oxidized, most of them are surface-treated with Ni plating, which is an inexpensive corrosion-proof coat having a good decorative property, a corrosion resistance, a chemical resistance and an abrasion resistance. A primer application must be carried out for them because of the poor reactivity of Ni plating with the anaerobic adhesives.

On the other hand, Cu and Fe are known as metals which have excellent reactivity and therefore do not require a primer. An R—Fe—B type permanent magnet comprising a Cu layer arranged on the surface has been known (e.g., see Reference 1). However, since the Cu layer is present on the surface as a film having a thickness of approximately from 1 to 60 μm, there is a possibility to cause a delamination. In addition, discoloration by the oxidation of Cu is significant, so that an after-treatment such as with, for example, a benzotriazole, indazole or imidazole nitrogen-containing cyclic compound must be carried out in order to prevent poor appearance, thus causing increase in costs.

SUMMARY OF THE INVENTION

In view of such problems, the present invention provides a layered product prepared by applying a surface treatment to an adherend having a surface with low a binding property with an anaerobic adhesive, which does not require a complex work, primer application, effected by accelerating an adhesive curing rate, and does not change surface conditions of the adherend.

As a means for solving such problems, the present invention provides:

1. a layered product, which comprises an adherend, an uneven deposition comprising Cu, V, a Cu alloy or a V alloy and having a height of 500 nm or less on the surface of the adherend, and an adhesive layer formed at least on the uneven deposition;

2. the layered product according to 1 above, wherein the uneven deposition comprises a plurality of dots of deposition;

3. the layered product according to 1 or 2 above, wherein the uneven deposition has a height of from 10 to 200 nm;

4. the layered product according to to 1 or 2 above, wherein the uneven deposition has a height of from 10 to 100 nm;

5. the layered product according to 1 or 2 above, wherein the adhesive is an anaerobic adhesive;

6. the layered product according to 1 or 2 above, wherein the adherend is an R—Fe—B type permanent magnet;

7. the layered product according to 1 or 2 above, which further comprises a Ni layer disposed on the surface of the adherend; and 8. the layered product according to any one of 1 to 7 above, wherein the uneven deposition comprises Cu.

According to the present invention, an anaerobic adhesive layer may be formed without carrying out a primer application even on an adherend having a poor reactivity with an anaerobic adhesive, a complex process for the primer application may be omitted, and speed-up of the adhesion process may be realized without waiting curing of the anaerobic adhesive for a prolonged period of time. In addition, even when Cu is deposited, discoloration by the oxidation of Cu is not conspicuous and the appearance also becomes good, since the deposition has a height of 500 nm at the maximum and is present in an uneven (preferably dotted) manner.

DETAILED DESCRIPTION OF THE INVENTION

Figure 1:
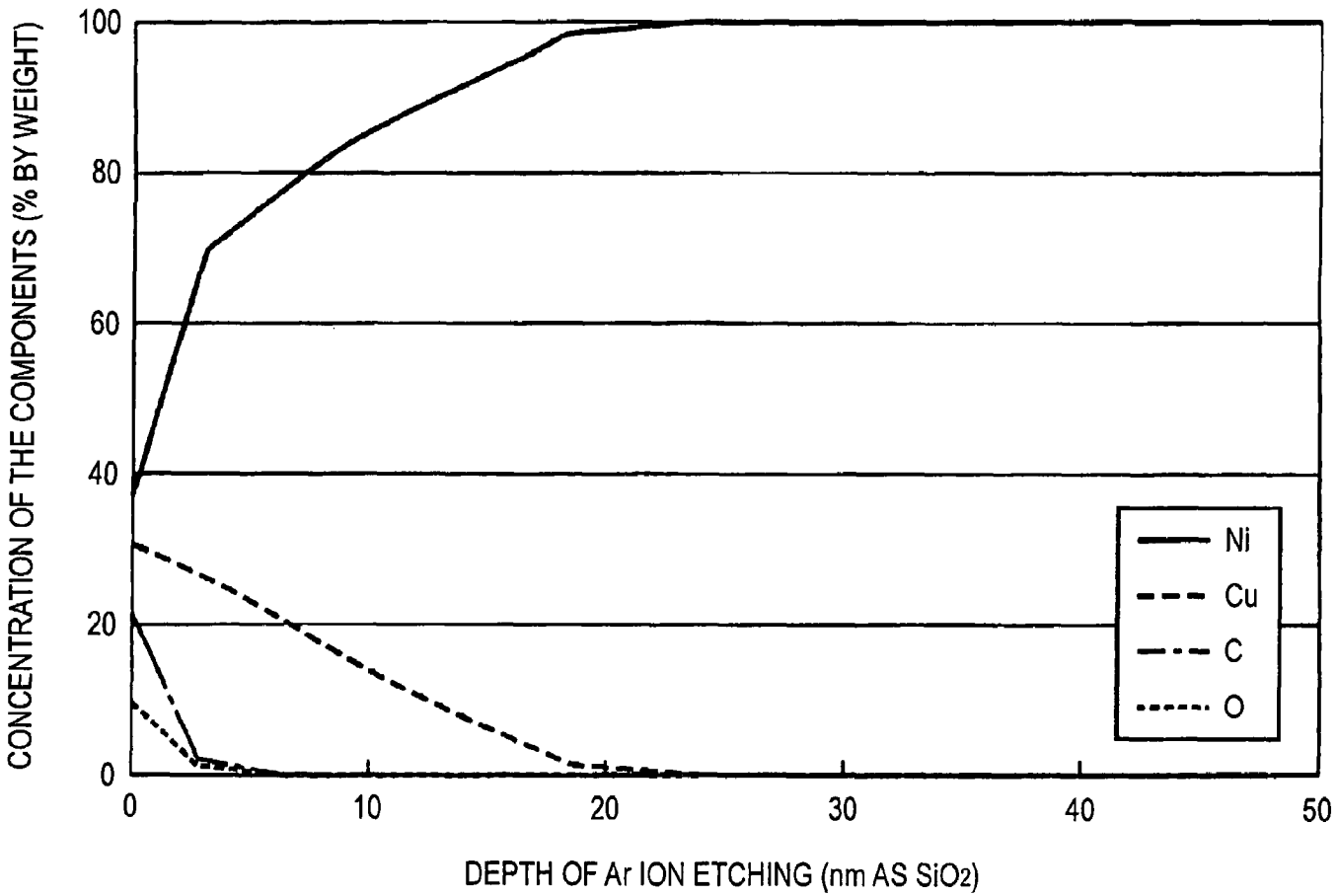
FIG. 1 is a graph showing a result of analysis of the components of respective surfaces, when a sample was prepared by forming an Ni plating layer on an R—Fe—B type permanent magnet and depositing Cu thereon by a plating method, and then the surface of the sample was subjected to Ar ion etching.

The following describes the present invention in detail.

The adherend is not particularly limited, and a material having a low binding property with the anaerobic adhesive is preferable. The examples thereof mainly include plastics, and metal materials having been subjected to a surface processing such as Ni plating. The present invention is particularly effective for materials having a low generation of metal ions. Particularly, in the case of using a sintered R—Fe—B type magnet which is easily oxidized, a plating, particularly Ni plating is applied in most cases as corrosion proof, and is effective in the present invention.

When the adherend is an R—Fe—B type permanent magnet, the main elements are R (R is at least one of rare-earth elements including Y), Fe and B, and it is preferable that the composition is of from 5 to 40% by weight of R, from 50 to 90% by weight of Fe and from 0.2 to 8% by weight of B, based on the total weight of the magnet. When the amount of R is less than 5% by weight, the precipitation amount of α-Fe becomes so large that high coercive force may not be obtained. When the amount of R exceeds 40% by weight, non-magnetic phase containing R becomes so large that the residual magnetic flux density may be reduced. When the amount of Fe is less than 50% by weight, the residual magnetic flux density is so low that the magnet characteristics may not be obtained. When the amount of Fe is larger than 90% by weight, the precipitation amount of α-Fe becomes so large that the high coercive force may not be obtained. When the amount of B is less than 0.2% by weight, high coercive force cannot be obtained. When the amount of B is larger than 8% by weight, B-rich non-magnetic phase becomes so large that the residual magnetic flux density may be reduced. In addition, the present invention includes R—Fe—B type permanent magnets to which at least one element selected from C, Al, Si, Ti, V, Cr, Mn, Co, Ni, Cu, Zn, Ga, Zr, Nb, Mo, Ag, Sn, Hf, Ta, W and the like elements has been added for the purpose of improving magnetic properties. Regarding the amount of these elements for addition, it is desirable that Co is 30% by weight or less, preferably from 0.5 to 20% by weight, and other elements are 8% by weight or less in total. Co is added for the purpose of improving the residual magnetic flux density, but the coercive force may be reduced when the amount of Co exceeds 30% by weight. The amount of other elements exceeding 8% by weight in total should be avoided because the magnetic properties may be deteriorated.

In producing a sintered R—Fe—B type magnet, firstly, the materials are blended into the composition described above, melted using a high frequency melting furnace or the like and molded to prepare an ingot, and the ingot is roughly pulverized using a jaw crusher, stamp mill or the like and then finely pulverized using a ball mill, jet mill or the like to obtain a fine powder having an average particle size of from 1 to 20 μm. Subsequently, this fine powder is formed in a magnetic field, sintered at from 1,000 to 1,250° C. for a period of from 0.5 to 10 hours and then finally heat-treated at from 400 to 900° C. to prepare the R—Fe—B type permanent magnet. Since the R—Fe—B type alloy is considerably liable to be oxidized, the aforementioned steps are preferably carried out in vacuo or in the inert atmosphere such as an argon gas or the like.

In addition, a surface treatment including Ni plating may be applied to the adherend. Particularly, when the adherend is a sintered R—Fe—B type magnet, Ni plating is effective to prevent a generation of corrosion on the surface. In the case of the Ni plating, it may be a glossy Ni plating, a matte Ni plating or a multi-layer plating in which Cu plating or the like is arranged as an intermediate layer. Good appearance having superior gloss can be obtained when the glossy Ni plating is used in the outermost surface layer. Even when a surface treatment is not necessary, adherends in which the surface itself has poor reactivity with an anaerobic adhesive are included in the present invention.

According to the present invention, a surface treatment is carried out to form depositions comprising Cu, V, a Cu alloy or a V alloy and having a height of 500 nm or less on the surface of the adherend. According to depositions comprising Cu or V, the concentration of Cu or V becomes continuously higher as the measuring point is closer to the outermost surface. The Cu alloy or V alloy includes an alloy which further comprises Ni, Sn or the like. The height of depositions is 500 nm at the maximum and preferably from 10 to 200 nm. More preferably, the height of depositions is from 10 to 100 nm. In order to form such depositions, wet plating method such as electroplating, now-etectrolytic plating, composite coatings or the like, mechanical plating method, vacuum film forming method such as vapor deposition, sputtering, ion plating or the like, CVD (chemical vapor deposition) method, PVD (physical vapor deposition) method and the like can be used. When depositions of exceeding 500 nm in height are to be formed by these techniques, they become a film and cover the adherend surface so that a possibility of causing delamination occurs. Particularly in the case of Cu or a Cu alloy, discoloration occurs after leaving it for a prolonged period of time, so that spots of Cu-specific copper (brown) color is developed and the appearance becomes poor. In addition, when a Ni plating layer intervenes, the decorative property, corrosion resistance, chemical resistance and abrasion resistance possessed by the Ni plating are completely replaced by those of Cu or a Cu alloy that are generally considered to be inferior Thereto. Based on such a point of view, the surface is covered unevenly (preferably dotted) with depositions having a height of 500 nm or less according to the present invention. In the present invention, the term "uneven deposition" preferably means a deposition that not only the components of deposition but also the components of the adherend or the layer formed on the adherend by a surface treatment (e.g. Ni plating) is partially detected as a result of the measurement of the surface thereof, according to the measurement using an X-ray photoelectron spectrum analyzer (XPS) or the like. When the Ni plating is carried out for the surface treatment, a chromate treatment is carried out in some cases as an after-treatment for its corrosion-proof treatment. The surface treatment in the present invention may be carried out jointly with the chromate treatment, and in that case, it is desirable to carry out the chromate treatment in advance. If the chromate treatment is carried out after the surface treatment of the present invention, it may be carried out after sufficiently confirming that effects of the surface treatment of the present invention are not deteriorated due to a strong oxidizing property of the chromate treatment.

Ni plating was applied to an R—Fe—B type permanent magnet, a sample was prepared thereon in which Cu was deposited by electroplating, and then a surface of the sample and a predetermined quantity of up to 50 nm at the maximum were subjected to etching by Ar ion. FIG. 1 is a graph showing a result of analysis of the components of respective surfaces using an X-ray photoelectron spectrum analyzer (XPS). As shown in FIG. 1, the depth in the sample where Cu was deposited was roughly 20 nm. Based on the total weight of the components, the content of Cu was about 30% by weight, the content of Ni was about 40% by weight and the content of the remainder was about 30% by weight of C and O on the outermost surface (0 nm in depth of Ar ion etching) before etching. It can be seen that depositions of Cu were dotted at a height of about 20 nm.

In addition, the measurement described above was performed on a sample which was an R—Fe—B type permanent magnet applied glossy Ni electroplating and subsequent Cu electroplating to form depositions of Cu thereon. When the height of depositions was more than 500 nm, the content of Cu on the outermost surface was about 70% by weight, and the content of contaminations of C, O and the like resulting from a small quantity of organic matter adhered to the outermost surface and oxidation of the surface was about 30% by weight, based on the total weight of the components. Ni was scarcely detected.

Further, when the height of depositions was 10 nm which is the lower point of the height of depositions preferred in the present invention, the content of Cu was 10 to 20 wt %, the content of Ni was 50-70 wt % and the content of the remainder was C, O and the like on the outermost surface, based on the total weight of the components.

According to the measurement with etching by Ar ion, the content of Cu decreased monotonically according to the depth direction. Consequently, the height of depositions of Cu deposited on the Ni plating of R—Fe—B type permanent magnet was not exactly even, and depositions of Cu had various heights of from a few nanometers to 30 nm at the maximum.

In the present invention, the height of depositions is defined as the depth at which the content of Cu or V becomes substantially 0 wt % according to the measurement using XPS. By using XPS, it is possible to perform an elemental analysis on the outermost surface of a sample. It is also possible to analyze a sample in the depth direction at the nanometer level by etching by Ar ion and the like during XPS analysis. Further, the present invention includes layered products which have depositions having a height of less than 500 nm, in the case that the height of depositions is measured by time-of-flight secondary ion mass spectrometry (TOF-SIMS), Auger electron spectroscopy, cross-section observation or the like.

C and O are contaminations resulting from a small quantity of organic matter adhered to the outermost surface and oxidation of the surface, and each of them disappears at an extremely shallow depth of less than 5 nm.

It is desirable to control the height of the depositions while confirming the curing rate acceleration effect for the anaerobic adhesive to be used. The height of depositions can also be accurately checked by measuring the surface of the adherend and inside of an etched part in the aforementioned manner, for example, by using an X-ray photoelectron spectrum analyzer (XPS) or the like.

Similar to the case using electroplating, in the case where depositions of Cu, V, a Cu alloy or a V alloy deposit on the surface of the adherend by using chemical plating, vapor deposition, vapor plating or the like, depositions are formed for a short period of time to avoid discoloration of the surface, and the surface condition is controlled with confirming the curing rate acceleration effect of the anaerobic adhesive or the height of depositions by XPS. When depositions of Cu or V deposit for a prolonged period of time, depositions of Cu or V form a film having a thickness of 500 nm or more which is not preferable as the present invention. Further, the formation of the film causes an oxidation and corrosion of Cu in some cases.

It is preferable to clean the surface of the adherend prior to the aforementioned metal deposition. It is preferable to carry out washing with pure water, an alcohol, a week acid or the like and alkaline degreasing or the like. In addition, among the aforementioned deposition methods, plating is particularly preferable in view of the workability.

The layered product of the present invention is prepared by applying an adhesive, particularly an anaerobic adhesive, to the surface of the adherend which is covered unevenly (preferably dotted) with depositions. The anaerobic adhesive means an adhesive which is stable in a condition that the adhesive is able to contact with oxygen in a container, and starts polymerization in a condition that oxygen is shielded and the adhesive receives catalytic activity provided by metal ions when the adhesive is disposed between the minute gap of metal. The anaerobic adhesive is preferably an acrylic adhesive. The anaerobic adhesive is more preferably an acrylic adhesive which comprises an acrylate monomer as the main component. It is preferable that the adhesive is applied so that the thickness after curing becomes from 10 to 100 μm, more preferably from 20 to 50 μm. The adhesive is cured under an anaerobic atmosphere at room temperature or, as occasion demands, by heating or compression. Also, the adhesive is used by dissolving in an organic solvent, for example, alcohols or hydrocarbons e.g., aromatic hydrocarbons. After applying the adhesive to the adherend, it is preferable to further laminate a desired material to be laminated, for example, a magnetic substance such as iron or the like in the case of magnet, under an uncured condition (semi-cured condition).

The desired material to be laminated is not limited to a metal material. A plastic material which cannot generate metal ions being important for anaerobic curing e.g. polyacetal copolymer may be used. Even when a plastic material is used, the anaerobic adhesive may be quickly cured by supply of Cu or V ions from the surface of the layered product according to the present invention. In this regard, a metal material which easily generates metal ions is more preferable as the desired material to be laminated to realize a quicker curing of the anaerobic adhesive and a higher adhesive strength.

In addition, when an R—Fe—B type permanent magnet is used as an adherend, the desired material to be laminated is a ferromagnetic material such as steel in many cases. In this case, both of the R—Fe—B type permanent magnet and the ferromagnetic material are usually subjected to a surface treatment, because both of them are easily to be oxidized. The present invention is effective even in the case described above. Especially when both of the R—Fe—B type permanent magnet and the ferromagnetic material are surface-treated using electroplating or electroless Ni plating which is poor for generating metal ions, the curing rate of the anaerobic adhesive is quick in comparison with that without the surface treatment of the present invention.

In addition, the adherend of the layered product may be molded with a resin or the like after the adhesion. When discoloration into copper color is not important as the appearance, Cu or a Cu alloy may be deposited without caring about the discoloration. In addition, an adhesion strength may be increased by applying a surface treatment such as plasma treatment or the like to the adhesive surface.

According to the layered product of the present invention, a surface treatment is carried out on the surface of the adherend to form dots of depositions comprising Cu, V, a Cu alloy or a V alloy and having a height of 500 nm or less, so that an application of a primer as a curing accelerator is not necessary for curing the anaerobic adhesive. When the surface is Ni plating, the superior decorative property, corrosion resistance, chemical resistance and abrasion resistance are not impaired.

EXAMPLES

The following illustratively describes embodiments of the present invention with reference to Examples, but the present invention is not limited thereto.

Example 1

Respective material metals having a purity of 99.9% by weight or more were melted using an induction heating high frequency melting furnace under an argon atmosphere and then molded to prepare an alloy ingot having a composition of 32Nd-59.3Fe-7Co-1.2B-0.5Al, as % by weight. This alloy ingot was subjected to a homogenized heat treatment at 1,100° C. for 24 hours under an argon atmosphere, roughly pulverized using jaw crusher and brown mill under an argon atmosphere, and then finely pulverized using jet mill under a nitrogen atmosphere to prepare an R—Fe—B type permanent magnet powder having an average particle size of 5 μm. With applying a magnetic field of 15 kOe to this magnet powder and applying a pressure of 1 ton/cm$^2$ to the vertical direction against the magnetic field-applying direction, the magnet powder was molded. This molding was sintered at 1,060° C. for 90 minutes in an argon atmosphere and then further subjected to an aging heat treatment at 540° C. to make it into a permanent magnet. A specimen of 5 mm×5 mm×1 mm was cut off from the permanent magnet thus obtained. A single layer glossy nickel plating was applied to the specimen, and then electric Cu plating was carried out for 20 seconds. After the plating, the height of Cu depositions from the surface of the specimen was measured by the XPS.

Also, the specimen was magnetized in a magnetic field of 30 kOe, 2 mg (from 30 to 50 μm in thickness after curing) of an anaerobic acrylic adhesive "3065 manufactured by Three Bond" was applied thereto, and then an Ni plating-applied iron plate of 5 cm in both length and width and 1 cm in thickness was, after wiping its surface with an alcohol, crimped to the applied face making use of the attraction of the magnet. Thereafter, this was allowed to stand at room temperature for 1, 3, 5 or 10 minutes to carry out a compressive shear test using a push-pull gage (mfd. by Imada Seisakusho, FB max 30 kg). The number of samples was 10 for each, and the average value was used as the adhesion strength.

Appearance of each sample was observed by comparing with that of Comparative Example 1, and evaluated as to whether the copper color is found on the glossy Ni plating.

Results of the measurement and evaluation are shown in Table 1. The unit of the adhesion strength in Table 1 is kgf.

Example 2

The duration of the electric copper plating in the Example 1 was changed to 30 seconds. Other conditions were the same as in the Example 1.

Example 3

The duration of the electric copper plating in the Example 1 was changed to 1 minute. Other conditions were the same as in the Example 1.

Comparative Example 1

The electric copper plating was not carried out. Other conditions were the same as in the Example 1.

Comparative Example 2

The electric copper plating in the Example 1 was not carried out, but "1390E manufactured by Three Bond" as the primer for anaerobic acrylic adhesive was applied to the face to which a magnet adheres. Other conditions were the same as in the Example 1. In the Comparative Example 2, the amount of depositions of the primer deposited from the surface of the specimen was not measured by the XPS.

TABLE 1

| | Adhesion strength (kgf) | | | | | Height of |
|---|---|---|---|---|---|---|
| Example | After 1 min | After 3 min | After 5 min | After 10 min | Appearance evaluation | Cu depositions |
| Ex. 1 | 1.8 | 11.5 | 15.9 | 23.8 | silver color with gloss | 31 nm |
| Ex. 2 | 1.9 | 12.1 | 16.2 | 23.6 | copper color only on edge | 64 nm |
| Ex. 3 | 1.9 | 12.7 | 16.6 | 24.2 | spots of copper color | 118 nm |
| Comp. Ex. 1 | 0.2 | 0.6 | 1.1 | 2.4 | silver color with gloss | 0 nm |
| Comp. Ex. 2 | 1.4 | 9.6 | 14.1 | 19.8 | silver color with no gloss | — |

As shown in Table 1, it was confirmed that, when the surface of an adherend is dotted with Cu depositions having a height of 500 nm or less in accordance with the present invention, adhesiveness with an anaerobic adhesive is increased without impairing the appearance.

While the present invention has been described in detail and with reference to specific embodiments thereof, it will be apparent to one skilled in the art that various changes and modifications can be made therein without departing from the scope thereof.

This application is based on Japanese patent application No. 2004-094379 filed Mar. 29, 2004, the entire contents thereof being hereby incorporated by reference.

What is claimed is:

1. A layered product, which comprises:

an adherend;

a Ni layer disposed on the surface of the adherend;

an uneven deposition comprising Cu, V, a Cu alloy or a V alloy and having a height of from 10 to 200 nm on the surface of the Ni layer; and an anaerobic adhesive layer formed at least on the uneven deposition.

2. The layered product according to claim 1, wherein the uneven deposition comprises a plurality of dots of deposition.

3. The layered product according to claim 1 or 2, wherein the uneven deposition has a height of from 10 to 100 nm.

4. The layered product according to claim 1 or 2, wherein the adherend is an R—Fe—B type permanent magnet.

5. The layered product according to claim 1, wherein the uneven deposition comprises Cu.

6. The layered product according to claim 2, wherein the uneven deposition comprises Cu.

7. The layered product according to claim 3, wherein the uneven deposition comprises Cu.

8. The layered product according to claim 4, wherein the uneven deposition comprises Cu.

* * * * *